US009527193B2

(12) United States Patent
Hsieh

(10) Patent No.: US 9,527,193 B2
(45) **Date of Patent: *Dec. 27, 2016**

(54) DOUBLE RATCHET STRUCTURE AND WRENCH

(71) Applicant: KABO TOOL COMPANY, Taichung (TW)

(72) Inventor: Chih-Ching Hsieh, Taichung (TW)

(73) Assignee: KABO TOOL COMPANY, Taichung (TW)

( * ) Notice: Subject to any disclaimer, the term of this patent is extended or adjusted under 35 U.S.C. 154(b) by 257 days.

This patent is subject to a terminal disclaimer.

(21) Appl. No.: 14/173,798

(22) Filed: Feb. 5, 2014

(65) Prior Publication Data

US 2014/0224079 A1 Aug. 14, 2014

(30) Foreign Application Priority Data

Feb. 8, 2013 (TW) ..... 102203098 U

(51) Int. Cl.
*B25B 13/46* (2006.01)

(52) U.S. Cl.
CPC ..... *B25B 13/465* (2013.01); *Y10T 74/214* (2015.01)

(58) Field of Classification Search
CPC ..... B25B 13/46; B25B 13/465; B25B 15/04; Y10T 74/214
USPC ..... 81/60, 62
See application file for complete search history.

(56) References Cited

U.S. PATENT DOCUMENTS 2,744,432 A * 5/1956 Rueb ..... B25B 13/465 81/62
6,976,409 B2 * 12/2005 Shu ..... B25B 13/465 81/62
7,055,410 B2 * 6/2006 Hu ..... B25B 15/04 81/62
7,066,054 B2 * 6/2006 Liu ..... B25B 13/465 81/62
9,186,781 B2 * 11/2015 Wang ..... B25B 13/463

* cited by examiner

*Primary Examiner* — Hadi Shakeri
(74) *Attorney, Agent, or Firm* — CKC & Partners Co., Ltd.

(57) ABSTRACT

A double ratchet structure includes a base, a first directional member, a second directional member, two resetting members, a choosing member, a driving member and a pivoting member. The first and second directional members are pivotally disposed on the base, and the first directional member pivots oppositely to the second directional member. The resetting members are respectively disposed between the first or the second directional member and the base for protruding the first or the second directional member from the base. The choosing member is coaxially and pivotally disposed on the base and covers the first and the second directional members. The choosing member catches the first or the second to pivot toward the base. The driving member is coaxially and pivotally disposed on the base through the pivoting member for engaging with the first or the second directional member.

15 Claims, 5 Drawing Sheets

DOUBLE RATCHET STRUCTURE AND WRENCH

RELATED APPLICATIONS

The application claims priority to Taiwan Application Serial Number 102203098, filed on Feb. 8, 2013, which is herein incorporated by reference.

BACKGROUND

Technical Field

The present disclosure relates to a ratchet, especially relates to a double ratchet structure and a double ratchet wrench.

Description of Related Art

Ratchet wrench is a kind of widely used hand tool. A ratchet wrench most commonly includes a handle and a ratchet structure attached to the handle. The ratchet structure can be used for loosening or tightening a fastener when the ratchet wrench is turned in one direction, and allows the handle to be re-positioned for another turn when the ratchet wrench is turned in the other direction. This ratcheting action allows the ratchet wrench be able to loosen or tighten the fastener repeatedly without disconnecting the ratchet wrench from the fastener.

The ratchet wrench improves the operation mode of a conventional ratchet wrench. For the conventional ratchet wrench, it is needed to dis-connect the ratchet wrench from the fastener in every turn due to the limitation on ergonomics. To the ratchet wrench, it not only provides a convenient operation mode but is especially suitable for loosening or tightening the fastener under some difficult situations. For example, when the angle or the space is limited and difficult for connecting or disconnecting the wrench. Nowadays, the ratchet wrench has becoming an important product in any kinds of industries.

For achieving loosening and tightening actions in single ratchet wrench, a kind of double ratchet wrench has been developed. Conventionally, this kind of double ratchet wrench utilizes a switch button for switching to different directions by a user.

However, there exits some issues on the conventional double ratchet wrench. For example, the complicated double ratchet structure makes the conventional double ratchet structure unstable. Furthermore, due to the limitation on the structure of the wrench, the switch button of the conventional double ratchet wrench commonly has a small size. Therefore, it is unreliable, easily broken, and not easily to switch directions on the conventional double ratchet wrench, and is inconvenient for regular usage.

SUMMARY

According to one aspect of the present disclosure, a double ratchet structure is provided. The double ratchet structure includes a base, a first directional member, a second directional member, two resetting members, a choosing member, a driving member and a pivoting member. The first directional member has a first pivot portion and a first claw, wherein the first claw is pivotally connected to the base via the first pivot portion. The second directional member has a second pivot portion and a second claw, wherein the second claw is pivotally connected to the base via the second pivot portion, and the second claw pivots oppositely to the first claw. One of the resetting members is against and disposed between the first directional member and the base for protruding the first claw from the base and the other resetting members is against and disposed between the second directional member and the base for protruding the second claw from the base. The choosing member is coaxially and pivotally disposed on the base and covering the first directional member and the second directional member, the choosing member has a detent portion, wherein the detent portion is for catching the first claw or the second claw, and the catched first claw or the catched second claw is pivoted toward the base. The driving member is coaxially disposed on the base and rotatable covering an outside of the first directional member and an outside of the second directional member, the driving member has an inner jaw portion for engaging with the first claw or the second claw. The pivoting member is coaxially disposed to the driving member and is coaxially and pivotally disposed on the base, wherein the driving member is coaxially and pivotally disposed on the base via the pivoting member According to another aspect of the present disclosure, a double ratchet wrench is provided. The double ratchet wrench includes a handle, a base, a first directional member, a second directional member, two resetting members, a choosing member, a drip member and a pivoting member. The base is disposed on the handle. The first directional member has a first pivot portion and a first claw, wherein the first claw is pivotally connected to the base via the first pivot portion. The second directional member has a second pivot portion and a second claw, wherein the second claw is pivotally connected to the base via the second pivot portion, and the second claw pivots oppositely to the first claw. One of the resetting members is against and disposed between the first directional member and the base for protruding the first claw from the base and the other resetting members is against and disposed between the second directional member and the base for protruding the second claw from the base. The choosing member is coaxially and pivotally disposed on the base and covering the first directional member and the second directional member, the choosing member has a detent portion, wherein the detent portion is for catching the first claw or the second claw, and the catched first claw or the catched second claw is pivoted toward the base. The driving member is coaxially disposed on the base and rotatably covering an outside of the first directional member and an outside of the second directional member, the driving member has an inner jaw portion for engaging with the first claw or the second claw. The pivoting member is coaxially disposed to the driving member and is coaxially and pivotally disposed on the base, wherein the driving member is coaxially and pivotally disposed on the base via the pivoting member.

BRIEF DESCRIPTION OF THE DRAWINGS

The present disclosure can be more fully understood by reading the following detailed description of the embodiment, with reference made to the accompanying drawings as follows.

DETAILED DESCRIPTION

The present disclosure provides a double ratchet wrench structure. Through the choosing member which covers the first directional member and the second directional member with opposite protruding directions, it is possible to catch the protruding direction of the first directional member or the second directional member. Therefore, the direction of the ratchet can be changed, and the stability of the double wrench structure is enhanced and is more convenient for operation.

Figure 1:
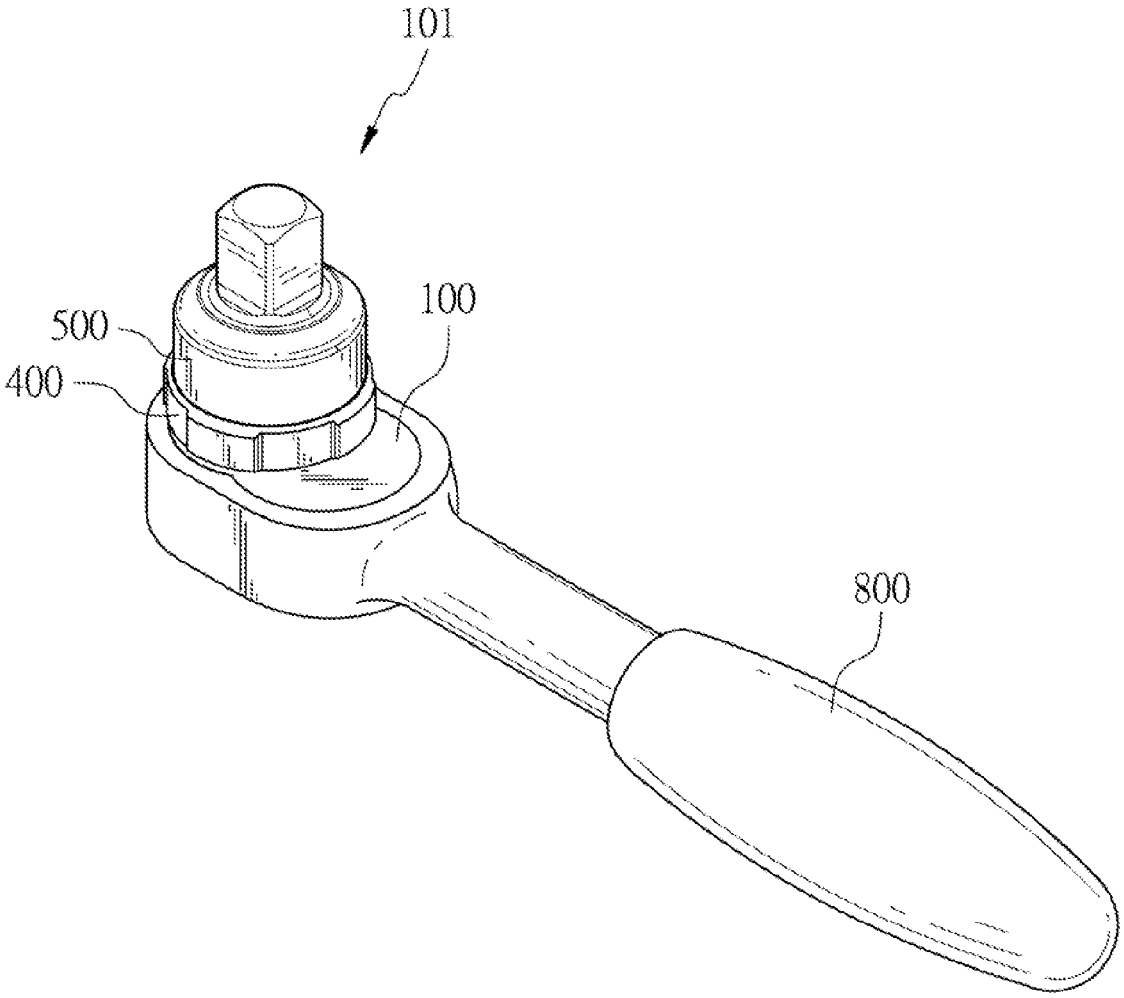
FIG. 1 is a three-dimensional view showing a double ratchet wrench according to one embodiment of the present disclosure.
Figure 2:
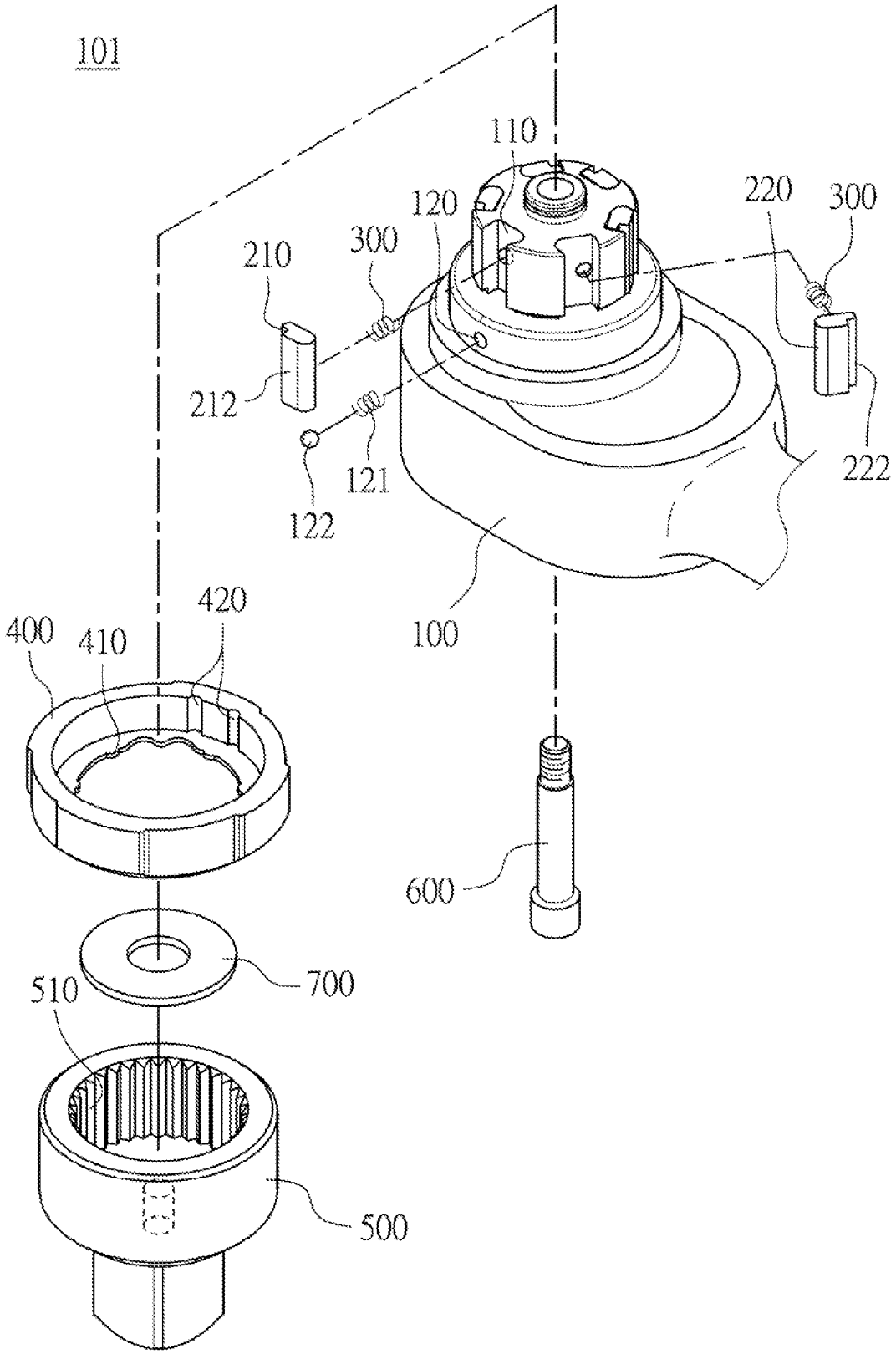
FIG. 2 is an exploded view showing a double ratchet structure of FIG. 1.
Figure 3:
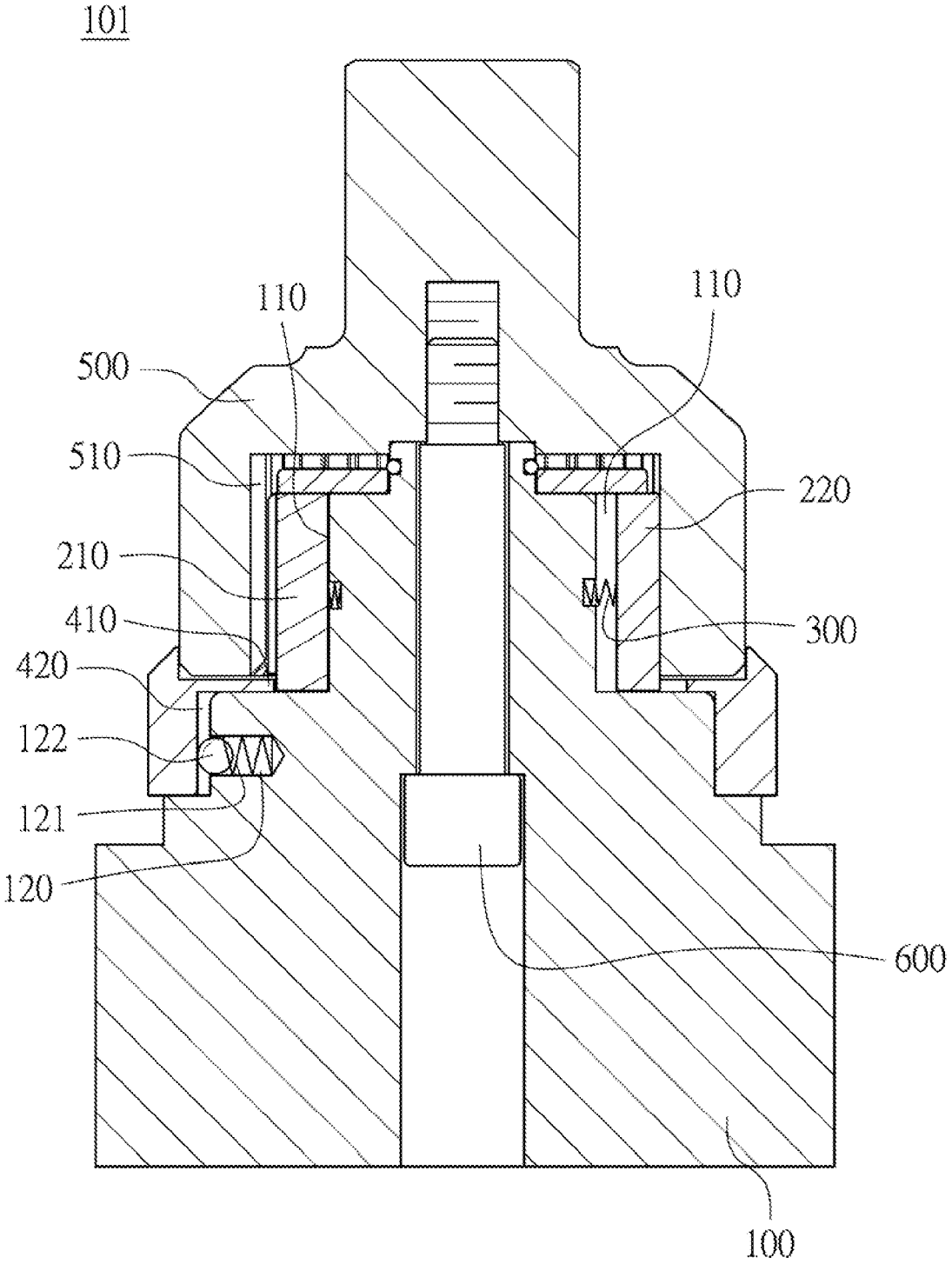
FIG. 3 is a section view showing the double ratchet structure of FIG. 1.
Figure 4:
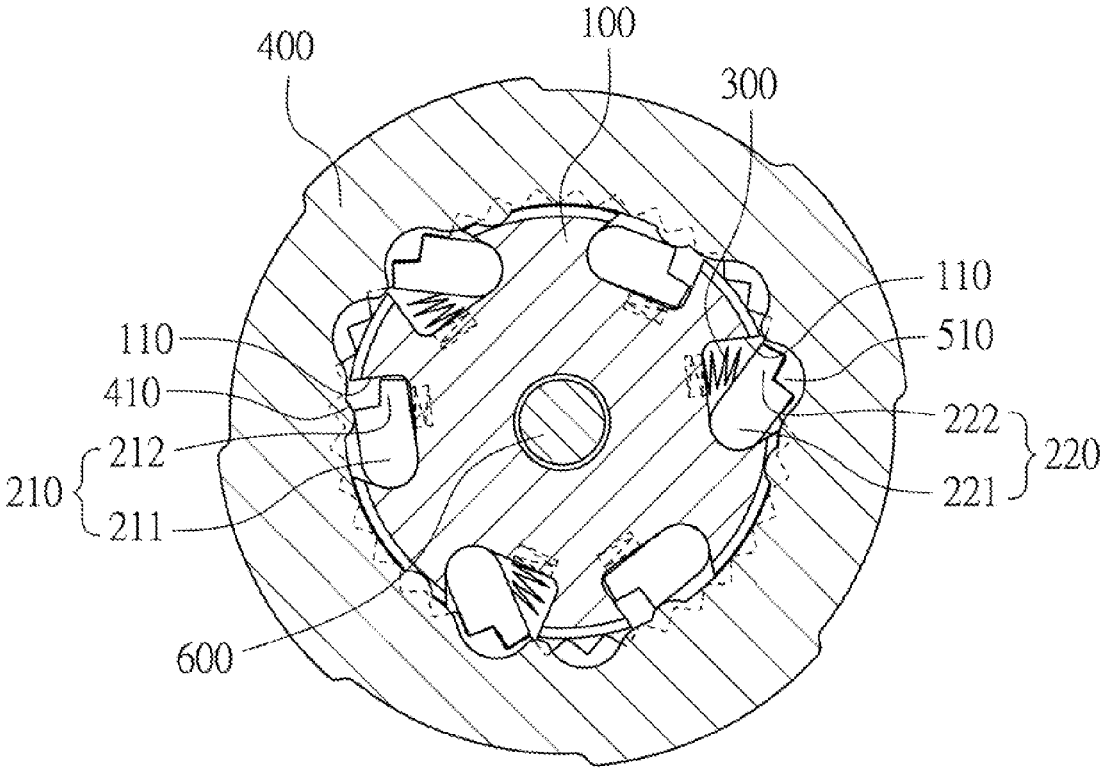
FIG. 4 is a schematic view showing a using state that a choosing member catches a first directional member of FIG. 2.

FIG. 1 is a three-dimensional view showing a double ratchet wrench according to one embodiment of the present disclosure; FIG. 2 is a exploded view showing a double ratchet structure 101 of FIG. 1; FIG. 3 is a section view showing the double ratchet structure 101 of FIG. 1; and FIG. 4 is a schematic view showing a using state that a choosing member 400 catches a first directional member 210 of FIG. 2.

In FIG. 1, the double ratchet wrench includes a double ratchet structure 101 and a handle 800. The double ratchet structure 101 is connected to the handle 800. The handle 800 is for holding by a user. The double ratchet structure 101 can be connected to one end of the handle 800. The handle 800 can be an H-type, but not limited. The double ratchet structure 101 also can be connected to the middle of the handle 800, or can be pivotally connected to the handle 800.

In FIGS. 1 and 2, the double ratchet structure 101 includes a base 100, a first directional member 210, a second directional member 220, two resetting members 300, a choosing member 400, a driving member 500, a pivoting member 600 and a gasket 700. The base 100 can have six recesses 110, and a quantity of the first directional member 210 and the second directional member 220 can be three respectively. Each first directional member 210 and each second directional member 220 are pivotally disposed in each of the recesses 110. For a clearer explanation, the quantity of the first directional member 210 and the second directional member 220 is taken one for example, respectively. It is known that the quantity of the first directional member 210 and the second directional member 220 are not limited to three, and the quantity of the recesses 110 of the base 100 also can be adjustable in accordance with the total quantity of the first directional member 210 and the second directional member 220.

Each first directional member 210 pivots in the same direction relative to the base 100, and each second directional member 220 pivots in the same direction relative to the base 100. Moreover, the first directional member 210 pivots oppositely to the second directional member 220. The first directional member 210 and the second directional member 220 are utilized for switching two rotational directions of the double ratchet structure 101.

The first directional member 210 and the resetting member 300 are disposed in a recess 110. The first directional member 210 has a first pivot portion 211 and a first claw 212.

The first claw 212 is pivotally connected to the base 100 via the first pivot portion 211. One resetting member 300 is against and disposed between the first directional member 210 and the recess 110 and protruding the first claw 212 from the base. The second directional member 220 and the other resetting member 300 are disposed in the other recess 110. The second directional member 220 has a second pivot portion 221 and a second claw 222. The second claw 222 is pivotally connected to the base 100 via the second pivot portion 221. One resetting member 300 is against and disposed between the second directional member 220 and the recess 110 and protruding the second claw 222 from the base. The first claw 212 pivots oppositely to the second claw 212. The quantity of the resetting member 300 can be adjustable in accordance with the total quantity of the first directional member 210 and the second directional member 220.

The choosing member 400 is coaxially and pivotally disposed on the base 100 and covers the first directional member 210 and the second directional member 220. The choosing member 400 has a detent portion 410. The detent portion 410 is used for switching and catching the first claw 212 or the second claw 222, and making the first claw 212 or the second claw 222 protruding toward the base 100. The driving member 500 is coaxially and pivotally disposed on the base 100, and the driving member 500 rotatably covers outside of the first directional member 210 and the second directional member 220. The driving member 500 has an inner jaw portion 510. The inner jaw portion 510 is engaged with the protruded first claw 212 or second claw 222.

The pivoting member 600 is coaxially disposed to the driving member 500 and is coaxially and pivotally disposed on the base 100 through the pivoting member 600. The driving member 500 is coaxially and pivotally disposed on the base 100 through the pivoting member 600. The gasket 700 is disposed between the driving member 500 and the base 100, the first directional member 210 and the second directional member 220.

The resetting member 300 can be a spring, a splinter or an elastic component. The driving member 500 can have a head of a corner wrench, a head of a hexagonal wrench, a head of a socket wrench or a wrench joint head for engaging with a fastener.

In FIG. 2 and FIG. 3, the base 100 of the double ratchet structure 101 can further include a base positioning portion 120. A positioning elastic member 121 and a positioning catching member 122 can be installed on the base positioning portion 120. The choosing member 400 can include at least one choosing positioning portion 420 in order to be cooperated with the positioning catching member 122. When the choosing member 400 rotatably switches and protrudes the first directional member 210 or the second directional member 220 to an ideal anchor point, the positioning elastic member 121 against and position the positioning catching member 122 to the choosing positioning portion 420. Therefore, the choosing member 400 is positioned to the base 100 temporary in order to ensure a switching of the double ratchet structure 101 is clear and stable. The positioning elastic member 121 can be a spring, and the positioning catching member 122 can be a ball or a steel ball. The choosing positioning portion 420 can be a recess disposed in the positioning portion in order to position the positioning catching member 122.

In FIGS. 3 and 4, wherein FIG. 4 is a schematic view showing a using state that a choosing member 400 catches a first directional member 210 of FIG. 2. The first directional member 210 pivots toward the base 100, and the second directional member 220 is not catched by the choosing member 400, therefore, the second directional member 220 is against by the resetting member 300 and is protruded from the recess 110 of the base 100. At the time, the second claw 222 is engaged with the inner jaw portion 510 of the driving member 500. If a force is applied to rotate, the driving member 500 is rotated by the second claw 222, but the driving member 500 is not rotated relative to the base 100, thus the driving member 500 is utilized for loosening or tightening a screw. If the force is rotated toward another direction, the second claw 222 pivots back to the base 100, and the driving member 500 is not forced and is operated idly relative to the base 100, therefore ratchet functionality can be achieved. If the catching member 400 is switched and is catched to the second directional member 220, the operation mechanism is similar to the above, but the driving member 500 is rotated toward another direction. Therefore, ratchet functionality is formed, and a double switching mechanism of the double ratchet structure 101 can be achieved.

Figure 5:
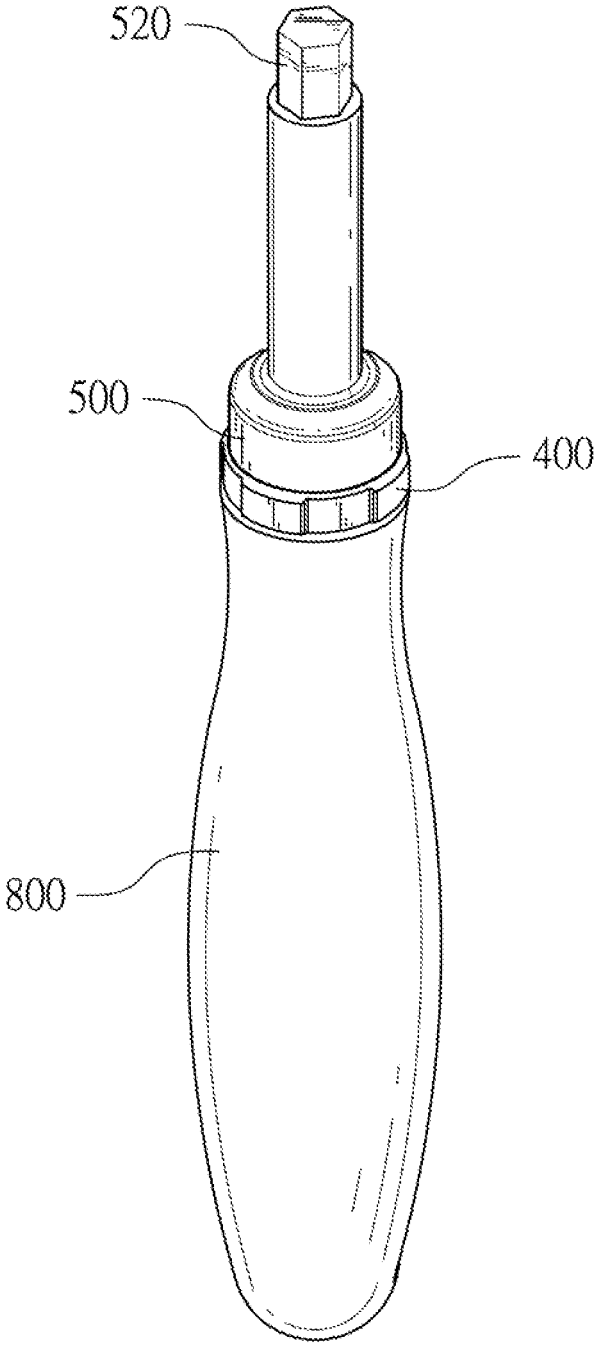
FIG. 5 is a three-dimensional view showing a double ratchet wrench according to another embodiment of the present disclosure.

FIG. 5 is three-dimensional view showing a double ratchet wrench according to another embodiment of the present disclosure. The handle 800 can be a screw driver. The driving member 500 includes a driving head 520, such as a head of a hexagonal wench. The driving head 520 can also be a head of a square wrench, a head of a socket wrench or an adapter head of a wrench. Suitable driving head 520 can be chosen in order to be applied to various situations.

In the aforementioned embodiments, an operation procedure of the double ratchet structure 101 of the present disclosure includes the following steps: the first directional member 210 and the second directional member 220 with opposite swigging directions are pivotally disposed on the base, wherein the first directional member 210 or the second directional member 220 has a resetting force which protrudes toward outside of the base 100 respectively; the first directional member 210 or the second directional member 220 is swigged back to the base 100; the first directional member 210 or the second directional member 220 which not swigged back is against by the resetting force and is protruded out from the base 100; the first directional member 210 or the second directional member 220 which not swigged back is engaged with the inner jaw portion 510 of the driving member 500, and makes the driving member 500 can only be rotated in one direction.

To sum up, the present disclosure has the following advantages:

1. Stable structure: a plurality of first directional members or second directional members are utilized, therefore the force applied to the double ratchet structure can be dispersed, thus the reliability and stability of the structure can be enhanced. Moreover, the choosing member and the base have larger installing plans, therefore the choosing member can be more stably installed on the base, and the structure is more stable and reliable than conventional double ratchet structure.

2. Stable switching: the choosing member covers the base in order to change directions. The choosing member can disperse the force applied to the ratchet to the first directional members or the second directional members during direction changing. Moreover, the first directional members and the second directional members are uniformly disposed around the base. Therefore, a smoother feeling during direction changing will be formed. To a user, it is easier to perform direction changing.

3. Easy switching: the choosing member covers the base in order to change direction, thus a level arm larger than the conventional double ratchet structure is formed. Moreover, the choosing member has a larger switching volume and a circle design, thus it is more favorable for operating when compared to conventional structure with a smaller volume and is only a small button.

In conclusion, a double ratchet structure, a double ratchet wrench and a direction changing method with high stability, high reliability and smoother operation feeling are provided in the present disclosure.

Although the present disclosure has been described in considerable detail with reference to certain embodiments thereof, other embodiments are possible. Therefore, the spirit and scope of the appended claims should not be limited to the description of the embodiments contained herein.

It will be apparent to those skilled in the art that various modifications and variations can be made to the structure of the present disclosure without departing from the scope or spirit of the disclosure. In view of the foregoing, it is intended that the present disclosure cover modifications and variations of this disclosure provided they fall within the scope of the following claims.

What is claimed is:

1. A double ratchet structure comprising:

a base;

a first directional member having a first pivot portion and a first claw, wherein the first claw is pivotally connected to the base via the first pivot portion;

a second directional member having a second pivot portion and a second claw, wherein the second claw is pivotally connected to the base via the second pivot portion, and the second claw pivots oppositely to the first claw;

two resetting members, wherein one of the resetting members is against and disposed between the first directional member and the base for protruding the first claw from the base, and the other resetting members is against and disposed between the second directional member and the base for protruding the second claw from the base;

a choosing member coaxially and pivotally disposed on the base and covering the first directional member and the second directional member, the choosing member having a detent portion, wherein the detent portion is inwardly protruded from the choosing member to contact with the first claw or the second claw and to resist an elastic force applied to the first directional member or the second directional member thereby preventing the first claw or the second claw from being protruded from the base;

a driving member coaxially disposed on the base and rotatably covering an outside of the first directional member and an outside of the second directional member, the driving member having an inner jaw portion for engaging with the first claw or the second claw; and a pivoting member coaxially disposed to the driving member and coaxially and pivotally disposed on the base, wherein the driving member is coaxially and pivotally disposed on the base via the pivoting member;

wherein the choosing member comprises an annular portion having an inner surface, a top, a bottom and a rim portion which extends radially inwardly from the inner surface of the annular portion at a location between the top and the bottom of the annular portion;

wherein the rim portion of the choosing member has a top surface which contacts the driving member, a bottom surface which contacts the base, and an innermost surface which defines the detent portion.

2. The double ratchet structure of claim 1, wherein the base comprises two recesses, the first directional member and one of the resetting members are located in one of the recesses, the second directional member and the other resetting member are located in the other recesses.

3. The double ratchet structure of claim 1, wherein the driving member comprises a head of a square wrench, a head of a hexagonal wrench, a head of a socket wrench or an adapter head of a wrench.

4. The double ratchet structure of claim 1, further comprising:

a gasket disposed between the base and the driving member.

5. The double ratchet structure of claim 1, wherein the inner surface of the annular portion above the rim portion surrounds a bottom section of an outer surface of the driving member, and the inner surface of the annular portion below the rim portion surrounds a top section of an outer surface of the base.

6. The double ratchet structure of claim 5, wherein the base comprises a base positioning portion, and a positioning elastic member and a positioning catching member accommodated in the base positioning portion, and the choosing member comprises a choosing positioning portion formed as a groove along the inner surface of the annular portion below the rim portion, wherein the positioning catching member is pushed by the positioning elastic member to press against the choosing positioning portion.

7. The double ratchet structure of claim 6, wherein the inner surface of the annular portion below the rim portion and outside of the choosing positioning portion tightly contacts the outer surface of the base so that no gaps are formed therebetween.

8. A double ratchet wrench comprising:

a handle;

a base disposed on the handle;

a first directional member having a first pivot portion and a first claw, wherein the first claw is pivotally connected to the base via the first pivot portion;

a second directional member having a second pivot portion and a second claw, wherein the second claw is pivotally connected to the base via the second pivot portion, and the second claw pivots oppositely to the first claw;

two resetting members, wherein one of the resetting members is against and disposed between the first directional member and the base for protruding the first claw from the base, and the other resetting members is against and disposed between the second directional member and the base for protruding the second claw from the base;

a choosing member coaxially and pivotally disposed on the base and covering the first directional member and the second directional member, the choosing member having a detent portion, wherein the detent portion is inwardly protruded from the choosing member to contact with the first claw or the second claw and to resist an elastic force applied to the first directional member or the second directional member thereby preventing the first claw or the second claw from being protruded from the base;

a driving member coaxially disposed on the base and rotatably covering an outside of the first directional member and an outside of the second directional member, the driving member having an inner jaw portion for engaging with the first claw or the second claw; and a pivoting member coaxially disposed to the driving member and coaxially and pivotally disposed on the base, wherein the driving member is coaxially and pivotally disposed on the base via the pivoting member;

wherein the choosing member comprises an annular portion having an inner surface, a top, a bottom and a rim portion which extends radially inwardly from the inner surface of the annular portion at a location between the too and the bottom of the annular portion;

wherein the rim portion of the choosing member has a too surface which contacts the driving member, a bottom surface which contacts the base, and an innermost surface which defines the detent portion.

9. The double ratchet wrench of claim 8, wherein the base is fixedly disposed on the handle.

10. The double ratchet wrench of claim 8, wherein the driving member comprises a head of a square wrench, a head of a hexagonal wrench, a head of a socket wrench or an adapter head of a wrench.

11. The double ratchet wrench of claim 8, wherein the base comprises two recesses, the first directional member and one of the resetting members are located in one of the recesses, the second directional member and the other resetting member are located in the other recesses.

12. The double ratchet wrench of claim 8, further comprising:

a gasket disposed between the base and the driving member.

13. The double ratchet wrench of claim 8, wherein the inner surface of the annular portion above the rim portion surrounds a bottom section of an outer surface of the driving member, and the inner surface of the annular portion below the rim portion surrounds a top section of an outer surface of the base.

14. The double ratchet wrench of claim 13, wherein the base comprises a base positioning portion, and a positioning elastic member and a positioning catching member accommodated in the base positioning portion, and the choosing member comprises a choosing positioning portion formed as a groove along the inner surface of the annular portion below the rim portion, wherein the positioning catching member is pushed by the positioning elastic member to press against the choosing positioning portion.

15. The double ratchet wrench of claim 14, wherein the inner surface of the annular portion below the rim portion and outside of the choosing positioning portion tightly contacts the outer surface of the base so that no gaps are formed therebetween.

* * * * *